US011059686B2

(12) United States Patent
Tamura et al.

(10) Patent No.: US 11,059,686 B2
(45) Date of Patent: Jul. 13, 2021

(54) SHEET STORAGE APPARATUS AND IMAGE FORMING APPARATUS

(71) Applicant: CANON KABUSHIKI KAISHA, Tokyo (JP)

(72) Inventors: Kouyou Tamura, Kashiwa (JP); Hajime Sekiguchi, Abiko (JP); Keitaro Taoka, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/840,578

(22) Filed: Apr. 6, 2020

(65) Prior Publication Data

US 2020/0339367 A1 Oct. 29, 2020

(30) Foreign Application Priority Data

Apr. 26, 2019 (JP) ..... JP2019-086861

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2405/114* (2013.01)

(58) Field of Classification Search
CPC ..... B65H 1/266; B65H 1/04; B65H 2511/12; B65H 2511/10; B65H 2405/112; B65H 31/20; B65H 31/34; B65H 31/36; B65H 31/38; B65H 31/40; B65H 2405/1116; B26D 7/015; B23Q 3/06
See application file for complete search history.

(56) References Cited

U.S. PATENT DOCUMENTS 1,407,565 A * 2/1922 Novick ..... B65H 9/04 271/171
3,061,303 A * 10/1962 Glaser ..... B65H 5/38 271/171
3,140,090 A * 7/1964 Winkler ..... B31B 70/00 271/171

FOREIGN PATENT DOCUMENTS

JP 2017-061384 A 3/2017
JP 2017061384 A * 3/2017

* cited by examiner

*Primary Examiner* — Gregory W Adams
(74) *Attorney, Agent, or Firm* — Venable LLP

(57) ABSTRACT

An image forming apparatus includes a side regulating plate provided in a sheet feeding cassette and a regulating surface to regulate an end position of a sheet stored in the sheet feeding cassette. A first arm connected with a first connector of the side regulating plate and a second arm connected with a second connector of the side regulating plate pivot on an axis extending in the gravity direction, wherein the second connector is different from the first connector in terms of a feeding direction. A first fixing part fixes the first arm to the sheet feeding cassette, and a second fixing part fixes the second arm to the sheet feeding cassette, wherein the first arm intersects with the second arm when viewed in the gravity direction when the side regulating plate is located in at least a part of a movable range of the side regulating plate.

11 Claims, 10 Drawing Sheets

SHEET STORAGE APPARATUS AND IMAGE FORMING APPARATUS

BACKGROUND OF THE INVENTION

Field of the Invention

The present invention relates to a sheet storage apparatus configured to store a sheet and an image forming apparatus configured to form an image on the sheet.

Description of the Related Art

In an image forming apparatus such as a printer, a copier and a multi-function printer, a sheet feeding cassette that can be inserted into and drawn out of an apparatus body is used as a sheet storage apparatus storing a sheet used as a recording material. A position of the sheet stored in the sheet feeding cassette is regulated by regulation members such as a side regulating plate and a trailing end regulating plate disposed within the cassette. However, if the regulation member is moved or inclined by being pressed by the sheet in drawing or inserting the sheet feeding cassette, the sheet may cause a positional deviation, possibly causing a positional deviation of the image formed on the sheet and/or an abnormal conveyance of the sheet.

Japanese Patent Application Laid-open No. 2017-61384 describes regulating an inclination (tilting) of a side fence configured to regulate a side end position of a sheet set in a sheet feeding tray by connecting one end of a tilt regulating member to the side fence and by fixing the tilt regulating member to the sheet feeding tray.

However, the tilt regulating member described in Japanese Patent Application Laid-open No. 2017-61384 is connected pivotably to the side fence. Due to that, there is a case where a moment of pivoting the side fence at a fulcrum of a connecting portion of the tilt regulating member and the side fence is generated when the side fence is pressed by the sheet in a state in which the tilt regulating member is fixed to the sheet feeding tray. Then, there is a possibility that it is unable to fully regulate a positional deviation of the sheet due to the deformation or the positional deviation that may turn the side fence in a top view.

SUMMARY OF THE INVENTION

The present invention provides sheet storage apparatus and image forming apparatus which can restrict positional deviation of a sheet more reliably.

According to one aspect of the invention, a sheet storage apparatus includes: a storage portion configured to store a sheet and to be inserted into and drawn out of an apparatus body along a first direction; a regulation member configured to be movable in the first direction with respect to the storage portion and including a regulating surface configured to regulate an end position in the first direction of the sheet stored in the storage portion; a first arm and a second arm each pivotably connected with the regulation member; and a fixing portion configured to fix the first and second arms to the storage portion. A position of a first connecting portion where the first arm is connected with the regulation member is different from a position of a second connecting portion where the second arm is connected with the regulation member in terms of a second direction intersecting with the first direction when viewed in a gravity direction.

According to another aspect of the invention, an image forming apparatus includes: a sheet storage apparatus configured to store a sheet; and an image forming unit configured to form an image on the sheet fed from the sheet storage apparatus. The sheet storage apparatus includes: a storage portion configured to store the sheet and to be inserted into and drawn out of an apparatus body along a first direction; a regulation member configured to be movable in the first direction with respect to the storage portion and including a regulating surface configured to regulate an end position in the first direction of the sheet stored in the storage portion; a first arm and a second arm each pivotably connected with the regulation member; and a fixing portion configured to fix the first and second arms to the storage portion. A position of a first connecting portion where the first arm is connected with the regulation member is different from a position of a second connecting portion where the second arm is connected with the regulation member in terms of a second direction intersecting with the first direction when viewed in a gravity direction.

Further features of the present invention will become apparent from the following description of exemplary embodiments with reference to the attached drawings.

DESCRIPTION OF THE EMBODIMENTS

Exemplary embodiments of the present invention will be described below with reference to the drawings.

First Embodiment

Firstly, an overall configuration of an image forming apparatus of a first embodiment will be described. A printer 100, which is the image forming apparatus of the present embodiment, is an electro-photographic full-color laser beam printer configured to form an image on a sheet S serving as a recording material based on image information read from a document or received from an external device. The sheet used as the recording material or the document includes papers such as plain paper and thick paper, a plastic film such as an overhead projector sheet, a cloth, a sheet material on which surface treatment is implemented such as coated paper, and a sheet material of specific shape such as an envelope and an index sheet.

Figure 1:
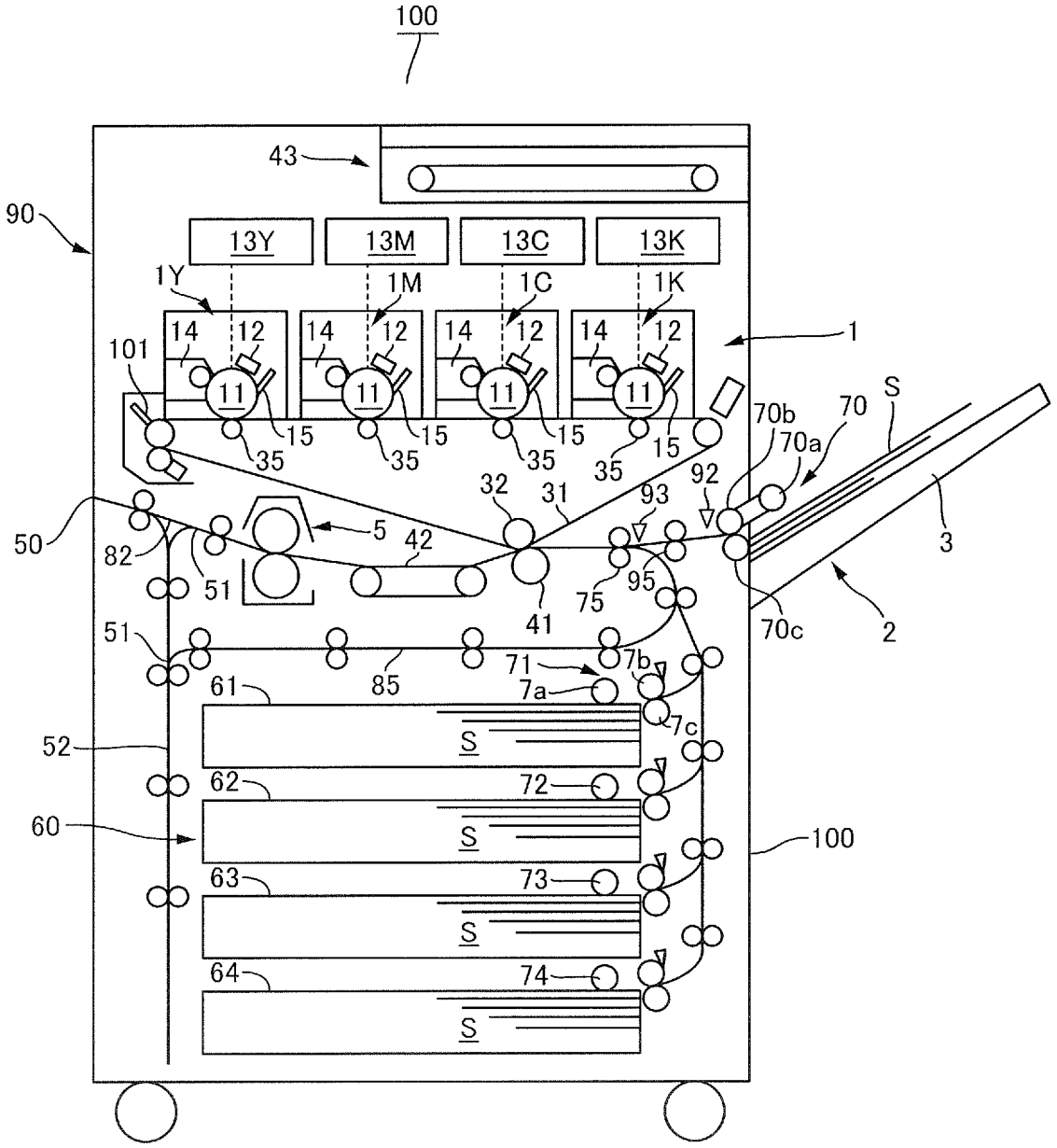
FIG. 1 is a schematic diagram illustrating a configuration of an image forming apparatus of a first embodiment.

As illustrated in FIG. 1, the printer 100 includes a reading unit 43 configured to read an image of a document and an apparatus body 90 provided under the reading unit 43. The apparatus body 90 includes a cassette feed portion 60, an image forming unit 1, a fixing unit 5 and a manual sheet feed portion 2.

The image forming unit 1 includes scanner units 13Y, 13M, 13C and 13K and four process cartridges 1Y, 1M, 1C and 1K configured to form four color images of yellow (Y), magenta (M), cyan (C) and black (K). Configurations of the four process cartridges 1Y through 1K are common except that their colors of images to be formed are different. Then, an image forming process of only the process cartridge 1Y will be described below and descriptions of the process cartridges 1M, 1C and 1K will be omitted here.

The scanner portion 13Y irradiates a photosensitive drum 11 of the process cartridge 1Y with a laser beam based on image information inputted thereto. At this time, the photosensitive drum 11 has been charged in advance by a charger 12, so that an electrostatic latent image is formed on the photosensitive drum 11 by the irradiation of the laser beam. After that, the electrostatic latent image is developed by a developer 14 and a yellow (Y) toner image is formed on the photosensitive drum 11.

Toner images of magenta (M) cyan (C) and black (K) are also formed in the same manner on photosensitive drums of the process cartridges 1M, 1C and 1K. The toner images of the respective colors formed on the respective photosensitive drums are transferred onto an intermediate transfer belt 31 by primary transfer rollers 35 and are conveyed toward a secondary transfer inner roller 32 by the intermediate transfer belt 31 being rotated. Adhesives such as transfer residual toner left on the photosensitive drum 11 without being transferred to the intermediate transfer belt 31 are removed by a cleaning blade 15. Note that the image forming process of each color is made with timing of superimposing the toner image onto an upstream toner image which has been primarily transferred onto the intermediate transfer belt 31.

In parallel with the image forming process described above, the sheet S is fed from the cassette feed portion 60 or the manual sheet feed portion 2. The cassette feed portion 60 includes four sheet feeding cassettes 61, 62, 63 and 64 and sheet feeding units 71, 72, 73 and 74 corresponding to the respective sheet feeding cassettes. The sheet S is fed from a sheet feeding cassette appropriately selected corresponding to a sheet size for example.

Each of the sheet feeding units 71 through 74 includes a pickup roller 7*a* delivering an uppermost sheet S out of a corresponding sheet feeding cassette, a feed roller 7*b* receiving the sheet S from the pickup roller 7*a* and conveying the sheet S, and a retard roller 7*c* being in contact with the feed roller 7*b*. A driving force in a direction against rotation of the feed roller 7*b* is inputted to the retard roller 7*c* through a torque limiter. The retard roller 7*c* pushes back a sheet other than the uppermost sheet S to the sheet feeding cassette by a frictional force applied to the sheet entering a separation nip between the feed roller 7*b* and the retard roller 7*c* in a direction opposite to a direction in which the sheet S is fed. The sheet feeding units 71 through 74 are one example of the sheet feeding unit configured to feed the sheet, and an air feeding system which holds an uppermost sheet to a belt by suctioning air may be used. Still further, instead of the retard roller 7*c* serving as the separation member separating fed sheets one by one, a pad-shaped frictional member may be used.

The manual sheet feed portion 2 includes a manual feed tray 3 projecting on a side of the apparatus body 90 and a sheet feeding unit 70 feeding a sheet S set in the manual feed tray 3. A basic configuration of the sheet feeding unit 70 is similar to the sheet feeding units 71 through 74 of the cassette feed portion 60. That is, the sheet feeding unit 70 includes a pickup roller 70*a* delivering an uppermost sheet S out of the manual feed tray 3, a feed roller 70*b* receiving the sheet S from the pickup roller and conveying the sheet S, and a retard roller 70*c* being in contact with the feed roller 70*b*.

The sheet S fed from the cassette feed portion 60 or the manual sheet feed portion 2 is conveyed to a registration roller pair 75 to correct a skew thereof and is conveyed further at a predetermined conveyance timing. Then, the full-color toner image on the intermediate transfer belt 31 is transferred onto the sheet S by a secondary transfer inner roller 32 and a secondary transfer outer roller 41. Adhesives such as transfer residual toner left on the intermediate transfer belt 31 without being transferred onto the sheet S are removed by a cleaning blade 101. The sheet S onto which the toner image has been transferred is conveyed further by a belt conveyance member 42 to a fixing unit 5 to undergo predetermined heat and pressure to melt and fix the toner. Then, the sheet S that has passed through the fixing unit 5 is discharged out of the apparatus through a sheet discharge port 50.

In a case of forming images on both surfaces of the sheet, the sheet S onto which the image has been formed on a first surface and has passed through the fixing unit 5 is conveyed to a reverse conveyance path 52, and two sides and front and rear of the sheet S are reversed by going through a switch-back conveyance system. Then, the sheet S is conveyed again to the registration roller pair 75 through a duplex conveyance path 85 and a toner image is transferred onto a second surface of the sheet S by the secondary transfer inner roller 32 and the secondary transfer outer roller 41.

The image forming unit 1 provided in the printer 100 of the present embodiment is one example of an image forming unit forming an image on a sheet, and a direct transfer type electro-photographic unit that directly transfers a toner image onto a sheet from a photosensitive member without an intermediary of an intermediate transfer member. Still further, an image forming unit other than the electro-photographic type such as an inkjet type image forming unit or an offset printing type printing mechanism may be used.

Sheet Feeding Cassette

Figure 2:
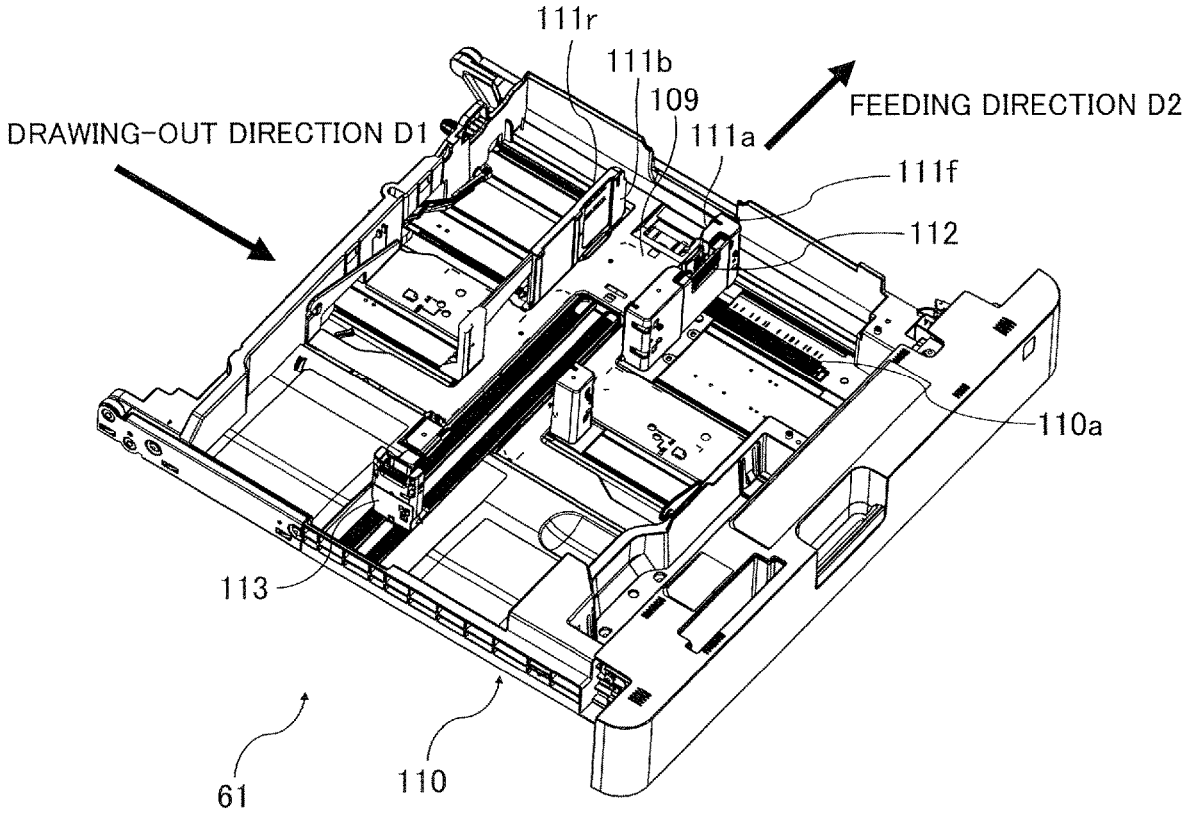
FIG. 2 is a perspective view illustrating a sheet feeding cassette of the first embodiment in a state in which a backup mechanism is removed.

Next, configurations of the sheet feeding cassettes 61 through 64 each serving as a sheet storage apparatus of the present embodiment will be described with reference to FIG. 2. Note that because the sheet feeding cassettes 61 through 64 have substantially the same configuration, the following description will be made by typically using the uppermost sheet feeding cassette 61.

The sheet feeding cassette 61 includes a sheet feeding tray 110, a sheet supporting portion 109, side regulating plates 111*f* and 111*r* and a trailing end regulating plate 113. The sheet feeding tray 110 is a storage portion forming a space for storing the sheet therein and configured to be insertable into and drawable out of the apparatus body 90. That is, the apparatus body 90 of the printer 100 also serves as an apparatus body of the sheet storage apparatus of the present embodiment. The sheet feeding cassette 61 is a front loading type sheet storage apparatus that can be inserted from and drawn out to a front side of the printer 100. Here, the front side of the printer 100 refers to a near side of the sheet surface of FIG. 1.

The sheet supporting portion 109 is a supporting member configured to support the sheet stored in the sheet feeding tray 110. A lift plate not illustrated is in contact with an under surface of the sheet supporting portion 109, and the lift plate is driven by a lift motor within the apparatus body to lift the sheet supporting portion 109 in a state in which the sheet feeding cassette 61 is inserted into the apparatus body.

A feeding direction D2 of the sheet stored in the sheet feeding tray 110 is a direction intersecting with a cassette drawing-out direction D1 of the sheet feeding cassette 61. Specifically, the feeding direction D2 is preferably a direction vertically intersecting with the cassette drawing-out direction D1 when viewed in the gravity direction in the present embodiment. The side regulating plates 111*f* and 111*r* are a pair of regulation members regulating positions of end portions of the sheet in the cassette drawing-out direction D1, i.e., in a width direction of the sheet. The side regulating plates 111*f* and 111*r* face each other in the cassette drawing-out direction D1. The side regulating plate 111*f* positioned on the front side of the printer 100 is a first regulation member of the present embodiment and the side regulating plate 111*r* is a second regulation member of the present embodiment. The side regulating plate 111*f* abuts with the sheet end portion on the front side of the printer 100, i.e., on a downstream side in the drawing-out direction D1, and the side regulating plate 111*r* abuts with the sheet end portion on a rear side of the printer 100, i.e., on an upstream side in the drawing-out direction D1.

In order to regulate the positions of the sheet end portion, the side regulating plates 111*f* and 111*r* are provided with regulating surfaces 111*a* and 111*b* extending in the feeding direction D2 and in a height direction of the sheet stored in the sheet feeding tray 110, i.e., in the gravity direction, in the present embodiment. A line or a character display indicating a maximum height of sheets loadable in the sheet feeding tray 110 is displayed on one of the regulating surfaces 111*a* and 111*b*, preferably on the regulating surface 111*b* on the rear side visible from the front side of the printer 100. In a case where the loadable height is different depending on a type of the sheet, the maximum loadable height indicates highest one among loadable heights per type of the sheet. In a case where there is no display or the like indicating the maximum loadable height, the maximum loadable height represents a position of an upper end of the regulating surfaces 111*a* and 111*b*.

The side regulating plates 111*f* and 111*r* are configured to be interlocked with each other through a rack and pinion mechanism not illustrated and move symmetrically with respect to a center position in the sheet width direction. Provided at the side regulating plate 111*f* on the front side is a releasing lever 112 capable of releasing an engagement of the side regulating plate 111*f* with an engagement portion 110*a* provided on a bottom portion of the sheet feeding tray 110. When a user operates the releasing lever 112, the side regulating plates 111*f* and 111*r* become movable in the sheet width direction as a claw engaging with the notch-shaped engage portion 110*a* recedes. When the user releases one's hand from the releasing lever 112, the claw engages again with the engagement portion 110*a* and movement of the side regulating plates 111*f* and 111*r* is restricted.

The trailing end regulating plate 113 is a trailing end regulation member regulating a position of a trailing end of the sheet in the feeding direction D2, i.e., an upstream end in the feeding direction D2, and is movable in the feeding direction D2 with respect to the sheet feeding tray 110. Similarly to the side regulating plate 111*f*, the trailing end regulating plate 113 becomes movable with respect to the sheet feeding tray 110 by operating a release lever and movement of the trailing end regulating plate 113 is regulated as the user releases one's hand from the release lever.

The user draws the sheet feeding cassette 61 out of the apparatus body 90 from the front side in replenishing sheets in the sheet feeding cassette 61 or in replacing the sheets.

Then, the user sets the sheets in the sheet feeding tray 110 after moving the side regulating plates 111*f* and 111*r* and the trailing end regulating plate 113 at predetermined positions corresponding to the size of the sheet to be set. After that, the user inserts the sheet feeding cassette 61 toward the rear side of the apparatus body 90 in the direction opposite to the cassette drawing-out direction D1.

The trailing end regulating plate 113 is a trailing end regulation member regulating a position of a trailing end of the sheet in the feeding direction D2, i.e., an upstream end in the feeding direction D2, and is movable in the feeding direction D2 with respect to the sheet feeding tray 110. Similarly to the side regulating plate 111*f*, the trailing end regulating plate 113 becomes movable with respect to the sheet feeding tray 110 by operating a release lever and the move of the trailing end regulating plate 113 is regulated as the user releases one's hand from the release lever.

The user draws the sheet feeding cassette 61 out of the apparatus body 90 from the front side in replenishing sheets in the sheet feeding cassette 61 or in replacing the sheets. Then, the user sets the sheets in the sheet feeding tray 110 after moving the side regulating plates 111*f* and 111*r* and the trailing end regulating plate 113 at predetermined positions corresponding to size of the sheet to be set. After that, the user inserts the sheet feeding cassette 61 toward the rear side of the apparatus body 90 in the direction opposite to the cassette drawing-out direction D1.

The sheet feeding cassette 61 is supported movably in the cassette drawing-out direction D1 through rails provided in the apparatus body 90. The rails are provided with a stopper to restrict the sheet feeding cassette 61 from being drawn out beyond a predetermined drawing-out position and from being fallen out of the apparatus body 90. Still further, in a case of inserting the sheet feeding cassette 61 into the apparatus body 90, the sheet feeding cassette 61 is positioned at a predetermined mount position, i.e., a position where feeding of the sheet can be executed by the sheet feeding unit 71, by abutting a part of the sheet feeding tray 110 with a frame member of the apparatus body 90.

Backup Mechanism of Side Regulating Plate

Figure 3:
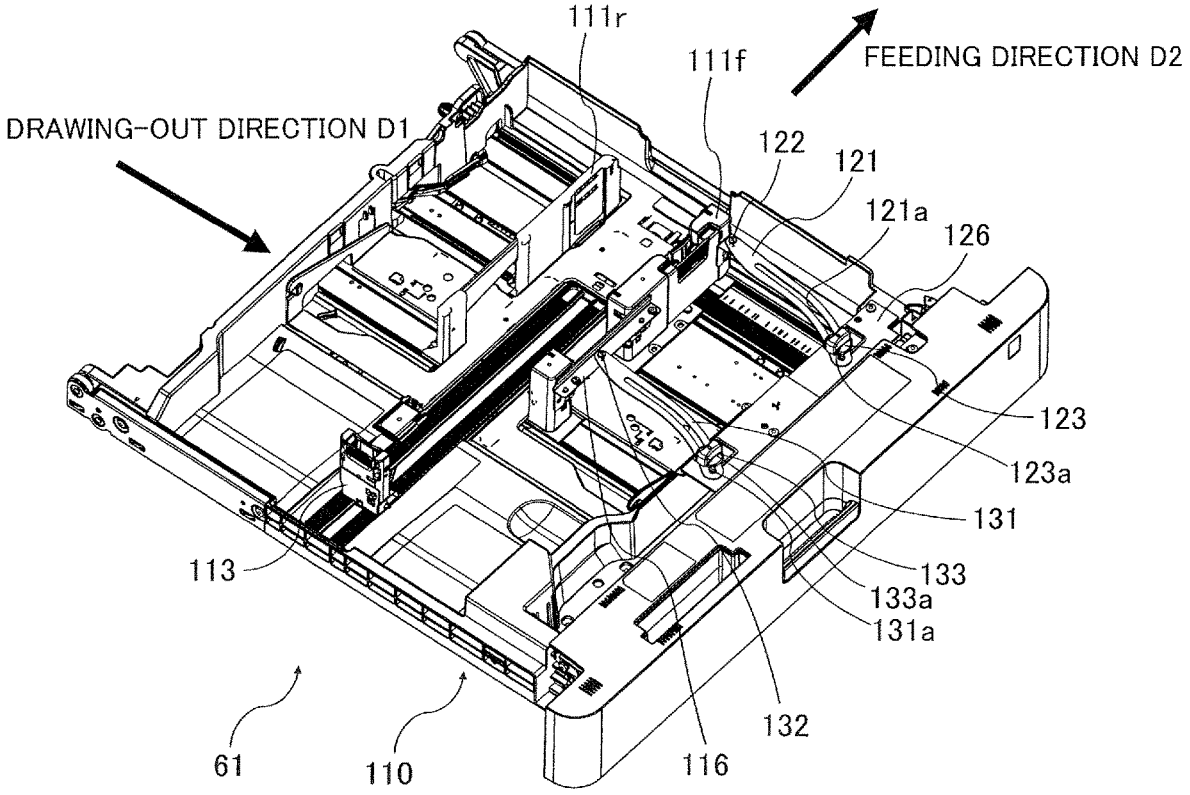
FIG. 3 is a perspective view illustrating the sheet feeding cassette of the first embodiment in a state in which side regulating plates are moved to inner positions.
Figure 4:
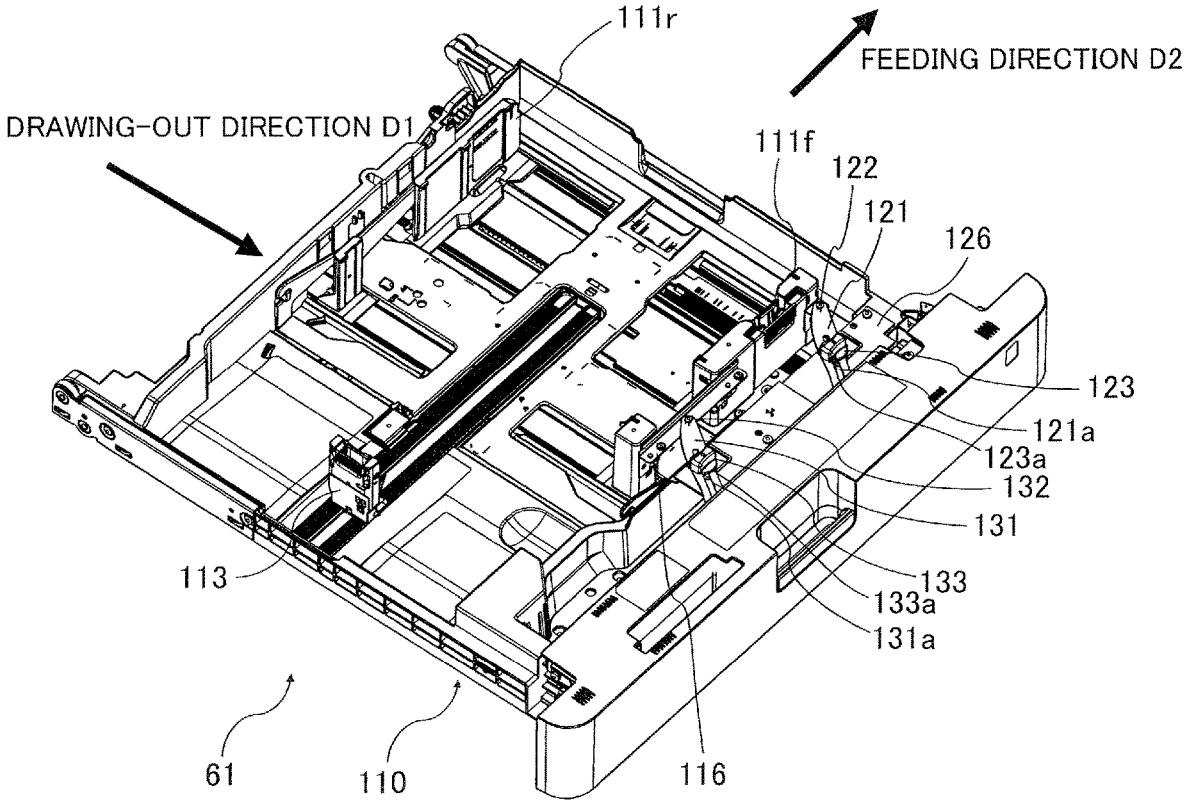
FIG. 4 is a perspective view illustrating the sheet feeding cassette of the first embodiment in a state in which the side regulating plates are moved to outer positions.
Figure 5:
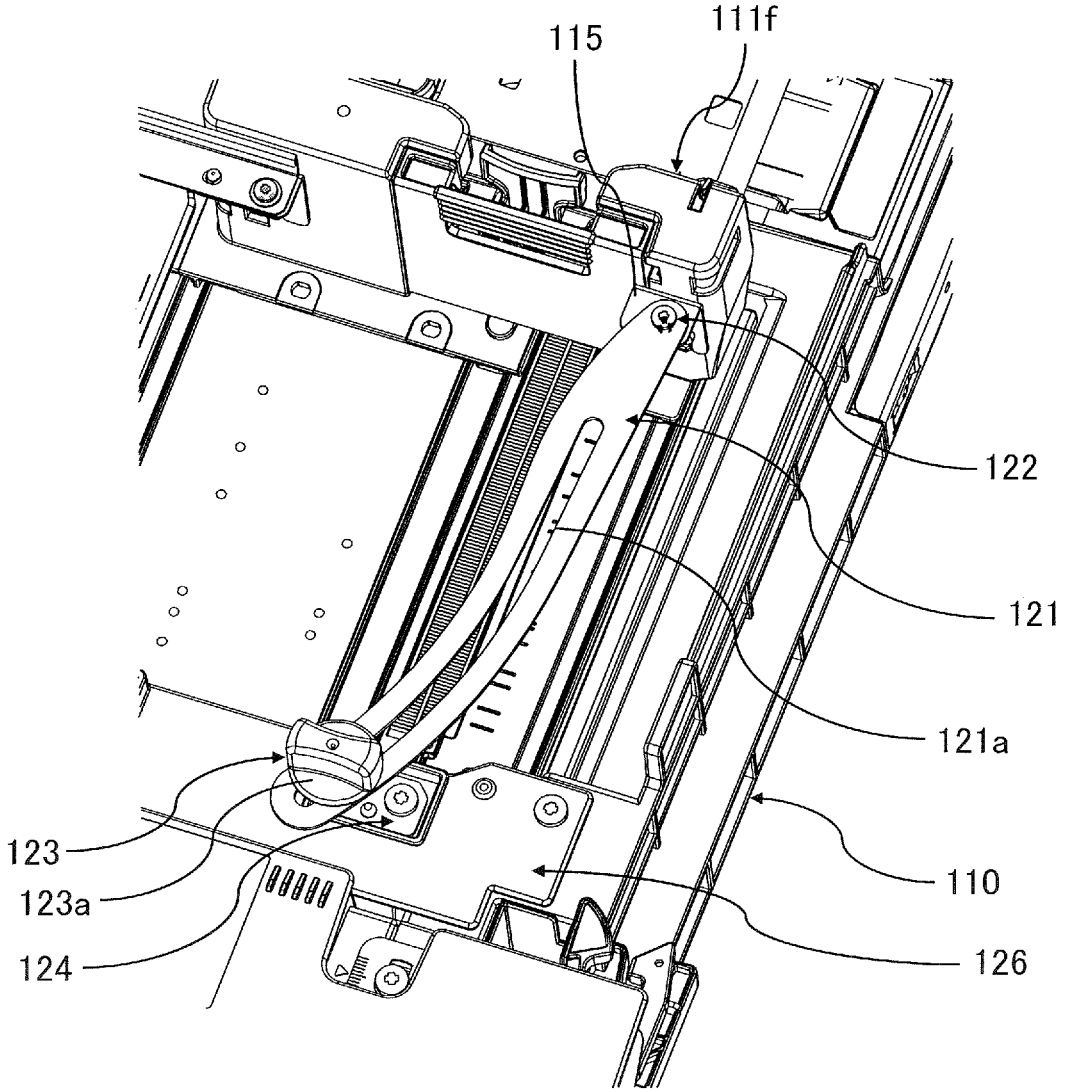
FIG. 5 is an enlarged view of a part of the backup mechanism of the first embodiment.
Figure 6:
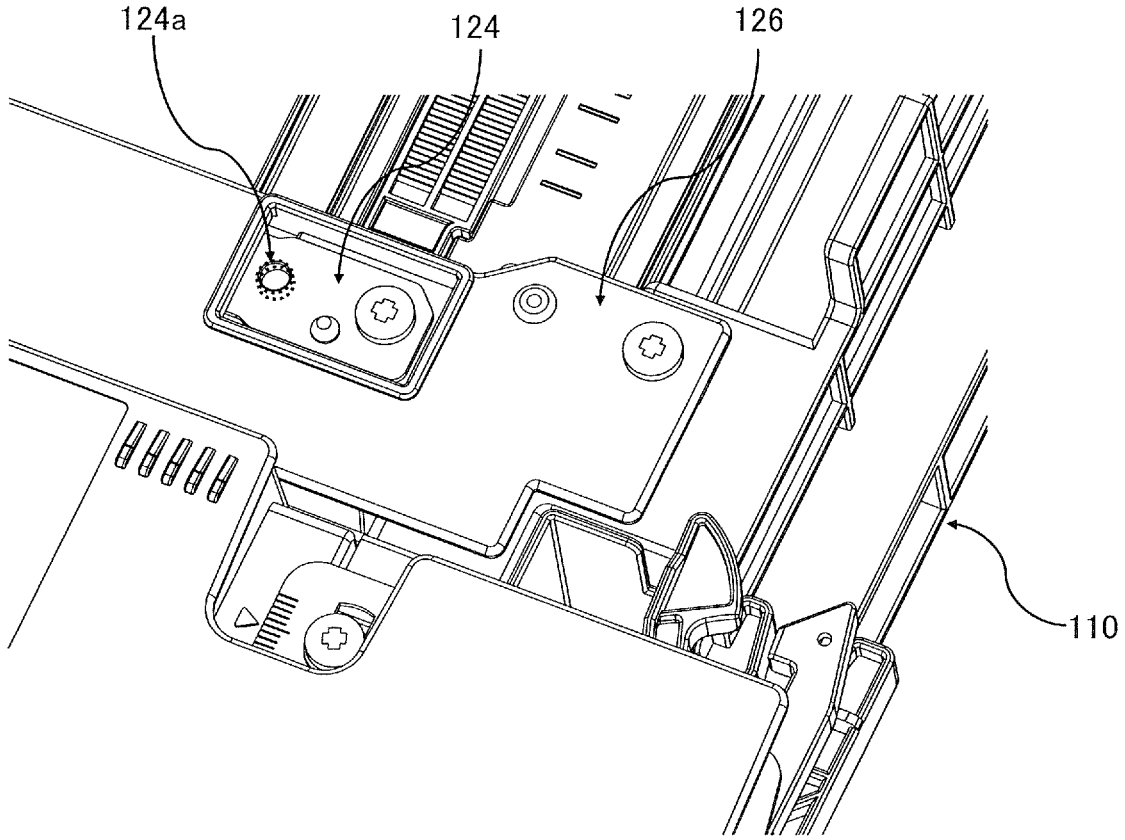
FIG. 6 is an enlarged view of a part of the backup mechanism of the first embodiment.

Next, a backup mechanism configured to suppress inclination of the side regulating plate 111*f* will be described with reference to FIGS. 3 through 6. FIG. 3 illustrates a state in which the side regulating plates 111*f* and 111*r* are moved to innermost positions (referred to as an "inner position" hereinafter) in the sheet width direction. FIG. 4 illustrates a state in which the side regulating plates 111*f* and 111*r* are moved to outermost positions (referred to as an "outer position" hereinafter) in the sheet width direction. FIG. 5 is an enlarged view in which a part of the backup mechanism is enlarged, and FIG. 6 is an enlarged view in a state in which a member, i.e., a first arm plate 121, which is a part of the backup mechanism is removed.

As illustrated in FIGS. 3 and 4, the backup mechanism includes first and second arm plates 121 and 131 and first and second fixing screws 123 and 133 serving as first and second screw members. The first arm plate 121 is a first arm of the present embodiment and the second arm plate 131 is a second arm of the present embodiment. Still further, the first fixing screw 123 serving as a first fixing part and the second fixing screw 133 serving as a second fixing part constitute a fixing portion of the present embodiment configured to fix the first and second arm plates 121 and 131 to the sheet feeding tray 110.

The first and second arm plates 121 and 131 are supported by the side regulating plate 111*f* in a state of being pivotable centering on a first support shaft 122 and a second support shaft 132, respectively. A rotational axis of each arm plate 121 and 131 extends approximately in the height direction of the sheets stored in the sheet feeding tray 110. Elongated holes 121*a* and 131*a* are perforated through the respective arm plates, and the first and second fixing screws 123 and 133 are attached to the sheet feeding tray 110 in a state of penetrating through these elongated holes 121*a* and 131*a*. As illustrated in FIGS. 5 and 6, a fastening plate 124 is attached to the mount 126 fixed to the sheet feeding tray 110 and a female screw portion 124*a* is formed through the fastening plate 124. The first fixing screw 123 engages with the female screw portion 124*a*. Another fastening plate provided with a female screw portion is attached to the mount 126. The second fixing screw 133 engages with this female screw portion. The first and second fixing screws 123 and 133 include heads 123*a* and 133*a* (see also FIGS. 3 and 4) having outer diameters larger than the elongated holes 121*a* and 131*a*. The user can screw and unscrew the respective screws by manually operating knob shapes of the heads 123*a* and 133*a*. The knob-shapes of the heads 123*a* and 133*a* are not limited to be straight as illustrated in the drawings and may be polygonal or circular for example in a top view.

In a state in which the first and second fixing screws 123 and 133 are unscrewed, the first and second arm plates 121 and 131 become movable with respect to the sheet feeding tray 110 as illustrated in FIGS. 3 and 4. That is, the fixing portion comes into a state of permitting the first and second arms to move. In this state, the first and second support shafts 122 and 132 move in the width direction of the sheet following the move of the side regulating plate 111*f* while keeping the state in which the first and second fixing screws 123 and 133 penetrate through the elongated holes 121*a* and 131*a* of the respective arm plates. Accordingly, the elongated holes 121*a* and 131*a* slide so as to be guided by the shaft portions of the first and second fixing screws 123 and 133 along with the move of the side regulating plate 111*f*.

In a state in which the side regulating plates 111*f* and 111*r* are moved to the inner position (see FIG. 3), the two arm plates 121 and 131 of the backup mechanism come into a state of being extended almost to their ends, i.e., to a state in which the fixing screw is positioned at one end of the elongated hole. In a state in which the side regulating plates 111*f* and 111*r* are moved to the outer position (see FIG. 4), the two arm plates 121 and 131 of the backup mechanism come into a state in which distances from the support shafts 122 and 132 to the fixing screws 123 and 133 are shortest, i.e., into a state in which the fixing screw is positioned at another end of the elongated hole.

When the user screws the first and second fixing screws 123 and 133 in a state in which the side regulating plates 111*f* and 111*r* are positioned at desirable positions, the first and second arm plates 121 and 131 are fixed to the sheet feeding tray 110, respectively. That is, the fixing portion is switched to a state of fixing the first and second arms. In this state, even if a force in the cassette drawing-out direction D1 acts to the side regulating plate 111*f*, the first and second arm plates 121 and 131 fixed to the sheet feeding tray 110 regulate a move or a displacement of the side regulating plate 111*f* in the cassette drawing-out direction D1. That is, the side regulating plate 111*f* is backed up by the sheet feeding tray 110 through the first and second arm plates 121 and 131.

A case where a large force in the cassette drawing-out direction D1 acts to the side regulating plate 111*f* is a case where the user powerfully draws out the sheet feeding cassette 61 in a state in which a large amount of sheets close to the maximum loading amount is loaded and the sheet feeding cassette 61 is suddenly stopped at the drawing-out position by the stopper. A force in the cassette drawing-out direction D1 also acts to the side regulating plate 111*f* by inertia of the sheets when the user powerfully inserts the sheet feeding cassette 61 in a state in which a large amount of sheets is loaded in the sheet feeding cassette 61 which has been drawn out of the apparatus body.

In such a case, it is possible to reduce a possibility of releasing the engagement at the engagement portion 110*a* and of causing displacement of the side regulating plate 111*f* by restricting the move or the displacement of the side regulating plate 111*f* by the backup mechanism. In the same time, it is also possible to prevent an upper part of the regulation plate from deforming and displacing so as to lean toward a downstream side in the cassette drawing-out direction D1 centering on a lower end portion fixed by the engagement portion 110*a*. Accordingly, the present backup mechanism makes it possible to reduce the move or the displacement of the side regulating plate 111*f* and to reduce positional deviation of the sheet stored in the sheet feeding tray 110.

Here, while the backup mechanism of the present embodiment includes the first and second arm plates 121 and 131 serving as two arm members, positions of parts of the respective arm members linked with the side regulating plate 111*f* are different. In other words, the first support shaft 122 serving as a first connecting portion and the second support shaft 132 serving as a second connecting portion are provided at positions separated from each other in terms of a second direction, i.e., the feeding direction D2, intersecting with a first direction, i.e., the cassette drawing-out direction D1, in which the cassette is inserted and drawn out. The first support shaft 122 is positioned downstream in the feeding direction D2 and the second support shaft 132 is positioned upstream. Thus, the side regulating plate 111*f* serving as the regulation member of the present embodiment is configured to be supported by the backup mechanism at least at two places in the feeding direction D2.

If the backup mechanism is supposedly configured by only one of the first arm plate 121 and the second arm plate 131, there is a possibility that the side regulating plate 111*f* is deformed so as to be turned by a force acting from the sheets to the side regulating plate 111*f*. That is, if an action point of force in the cassette drawing-out direction D1 acting on the side regulating plate 111*f* deviates from the connecting position of the side regulating plate 111*f* and the arm plate in terms of the feeding direction D2, a moment that turns the side regulating plate 111*f* is generated centering on the connecting position when seen from above. If the deformation and the positional deviation of the side regulating plate 111*f* occur by such moment, the positional deviation of the sheet may occur, possibly causing such influences of degradation of stability of a sheet feeding operation and an inclination of an image formed on the sheet.

Meanwhile, two places of upstream and downstream of the side regulating plate 111*f* in the feeding direction D2 are fixed by the backup mechanism according to the present embodiment. Therefore, even if a force acts on the side regulating plate 111*f* in opening/closing the cassette, it is possible to steadily regulate the deformation of the side regulating plate 111*f* and to reduce the positional deviation of the sheet.

In order to enhance the abovementioned advantages, it is preferable to dispose the first and second support shafts 122 and 132 separately at downstream and upstream portions of the side regulating plate 111*f* in the feeding direction D2. The downstream and upstream portions of the side regulating plate 111*f* refer to downstream and upstream parts respectively in the feeding direction D2 with respect to a center position of both end portions in the feeding direction D2 within a range in which the regulating surface 111*a* can abut with the end portions of the sheet. In other words, preferably the first connecting portion is positioned on one side and the second connecting portion is positioned on another side, in terms of the second direction, with respect to the center position between the both end portions of the range in which the regulating surface of the regulation member can abut with the end portions of the sheet.

It is also preferable to provide the connecting positions of the first and second arm plates 121 and 131 and the side regulating plate 111*f* at an upper part of the side regulating plate 111*f* in order to more effectively regulate the side regulating plate 111*f* from leaning with respect to the gravity direction when seen from the feeding direction D2. The first and second support shafts 122 and 132 of the present embodiment are provided at positions above a lower end portion of the regulating surface 111*a* of the side regulating plates 111*f* and higher than a half of the maximum loading height of the sheet feeding tray 110 based on a lower end position of the regulating surface 111*a*. Here, the lower end position of the regulating surface 111*a* refers to a lower end of a range where the regulating surface 111*a* is contactable with an end portion of the sheets loaded on the sheet supporting portion 109.

Note that the positions of the first support shaft 122 and the first fixing screw 123 in the feeding direction D2 are different and the positions of the second support shaft 132 and the second fixing screw 133 are also different. Therefore, as the side regulating plate 111*f* is moved toward the outside, i.e., toward the front side of the printer, the first and second arm plates 121 and 131 pivot such that an inclination with respect to the sheet width direction increases. In a state illustrated in FIG. 4, an occupancy width of the first and second arm plates 121 and 131 in the sheet width direction, i.e., in the cassette drawing-out direction D1, is narrow as compared to the state illustrated in FIG. 3.

Figure 9:
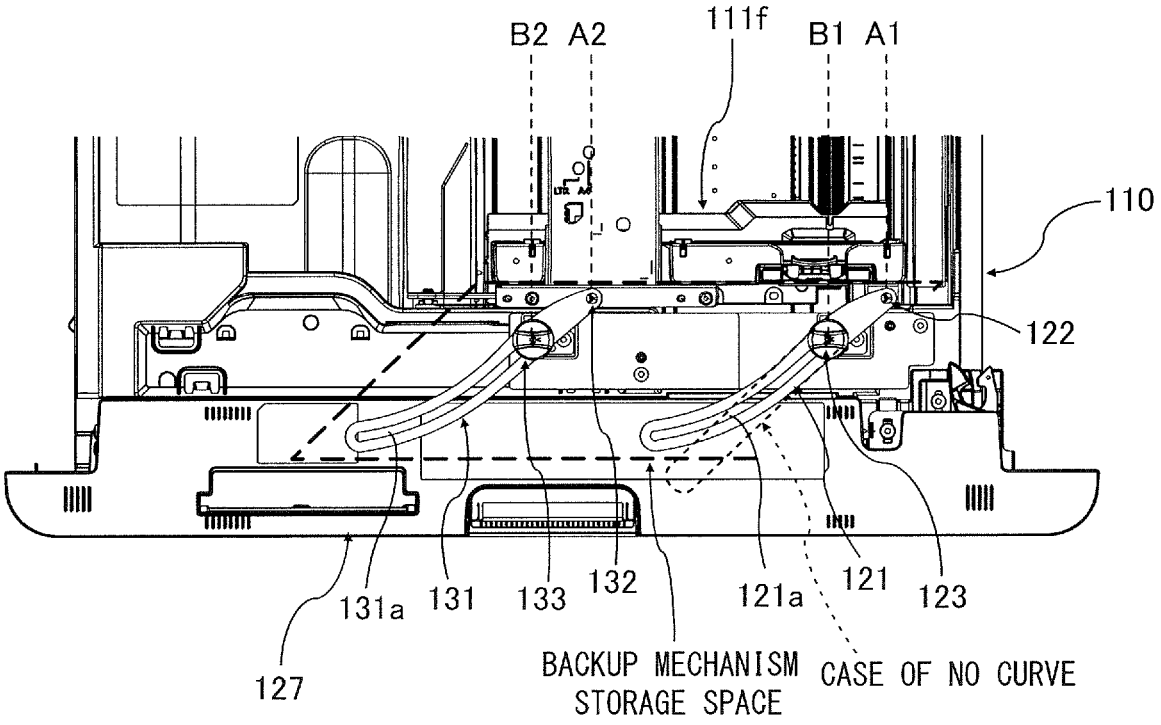
FIG. 9 is an upper plan view of the backup mechanism of the first embodiment.

Here, it is possible to restrain the occupancy width of the arm plate in the cassette drawing-out direction D1 to be small by curving the respective arm plates 121 and 131 as illustrated in FIG. 5. The position of the first support shaft 122 and the position of the first fixing screw 123 are offset in the feeding direction D2 in terms of the first arm plate 121. Then, the first arm plate 121 is curved in a same direction with a direction of the offset of the first fixing screw 123 to the first support shaft 122 in terms of the feeding direction D2, i.e., to left in FIG. 5, as the first arm plate 121 heads toward the outside in the sheet width direction. The occupancy width of the first arm plate 121 in the cassette drawing-out direction D1 when the side regulating plate 111*f* is moved to the outer position as illustrated in FIGS. 4 and 9 becomes small as compared to a case where the arm plate is formed straightly (see a broken line in FIG. 9). The second arm plate 131 is also similarly curved. Specifically, it is possible to reduce manufacturing costs by communizing parts by forming the first and second arm plates 121 and 131 into the same shape.

It is noted that in the configuration illustrated in FIGS. 3 through 6, the first and second support shafts 122 and 132 are configured by screw members, i.e., stepped screws, screwed to stay members 115 (see FIG. 5) and 116 (see FIG. 4) attached as another member to the side regulating plate 111*f*. Instead of such configuration, parts that pivotably support the arm members of the backup mechanism such as the stay members 115 and 116 for example may be molded as members integrated with the side regulating plate 111*f*. Still further, the support shafts 122 and 132 are not limited to be the stepped screws and may be metal shafts attached to the stay members 115 and 116 by caulking. The part on which the arm member of the backup mechanism is fixed like the mount 126 of the present embodiment may be molded as a member integrated with a body of the storage portion, i.e., the sheet feeding tray 110.

Second Embodiment

Next, a sheet feeding cassette of a second embodiment will be described with reference to FIG. 7 through 9. The present embodiment is different from the first embodiment in that two arm members constituting a backup mechanism of regulation members are disposed so as to intersect with each other. Component elements having the same configuration and action with those of the first embodiment will be denoted by the common reference signs, and their description will be omitted here.

Figure 7:
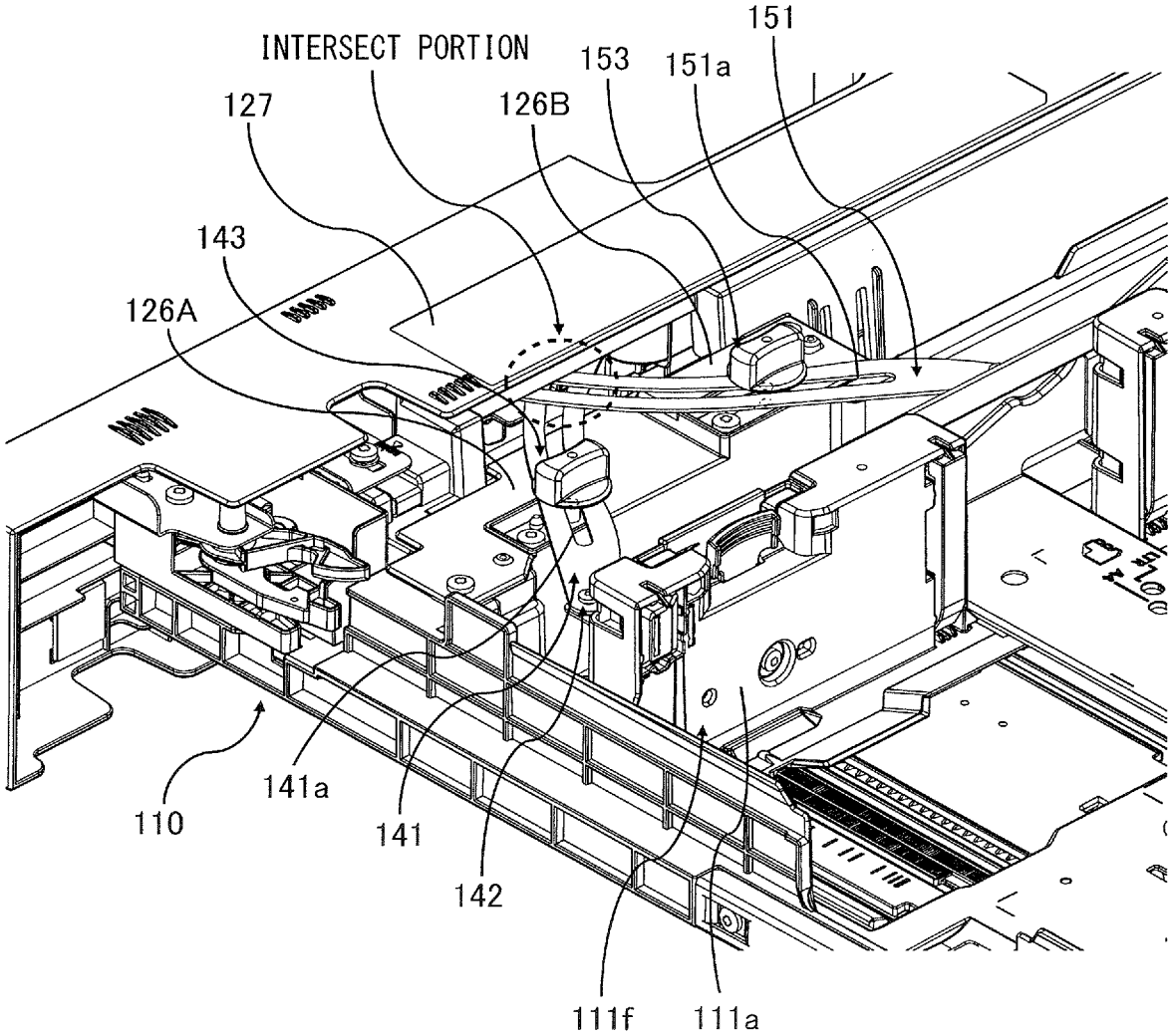
FIG. 7 is a perspective view of a backup mechanism of a second embodiment.

As illustrated in FIG. 7, a backup mechanism of the present embodiment is configured such a side regulating plate 111*f* on the front side of the printer in the sheet feeding cassette is connected with the sheet feeding tray 110 by two arm members 141 and 151 similarly to the first embodiment. A first support shaft 142 supporting the first arm plate 141 and a first support shaft 152 supporting the second arm plate 151 are disposed at positions separated in terms of the feeding direction D2. The first arm plate 141 is a first arm of the present embodiment and the second arm plate 151 is a second arm of the present embodiment. The first support shaft 142 is a first connecting portion of the present embodiment and the first support shaft 152 is a second connecting portion of the present embodiment. A first fixing screw 143 serving as a first fixing part and a second fixing screw 153 serving as a second fixing part constitute a fixing portion of the present embodiment.

The user can switch a state in which the first and second arm plates 141 and 151 are fixed to the sheet feeding tray 110 and a state in which the first and second arm plates 141 and 151 are movable by screwing and unscrewing the first and second fixing screws 143 and 153, i.e., first and second screw members. In the state in which the first and second arm plates 141 and 151 are fixed to the sheet feeding tray 110, the side regulating plate 111*f* is restricted from displacing in the cassette drawing-out direction D1 at least at two places in the feeding direction D2. Therefore, it is possible to prevent the side regulating plate 111*f* from being deformed so as to turn and to steadily restrict the positional deviation of the sheets similarly to the first embodiment.

Note that positions in the height direction of the first and second arm plates 141 and 151 are different, and the first and second arm plates 141 and 151 are disposed so as to intersect with each other in the present embodiment as illustrated in FIG. 7. In other words, in a state in which the side regulating plate 111*f* is positioned in at least a part of own movable range, the first and second arm plates 141 and 151 intersect with each other when viewed in the gravity direction.

Figure 8:
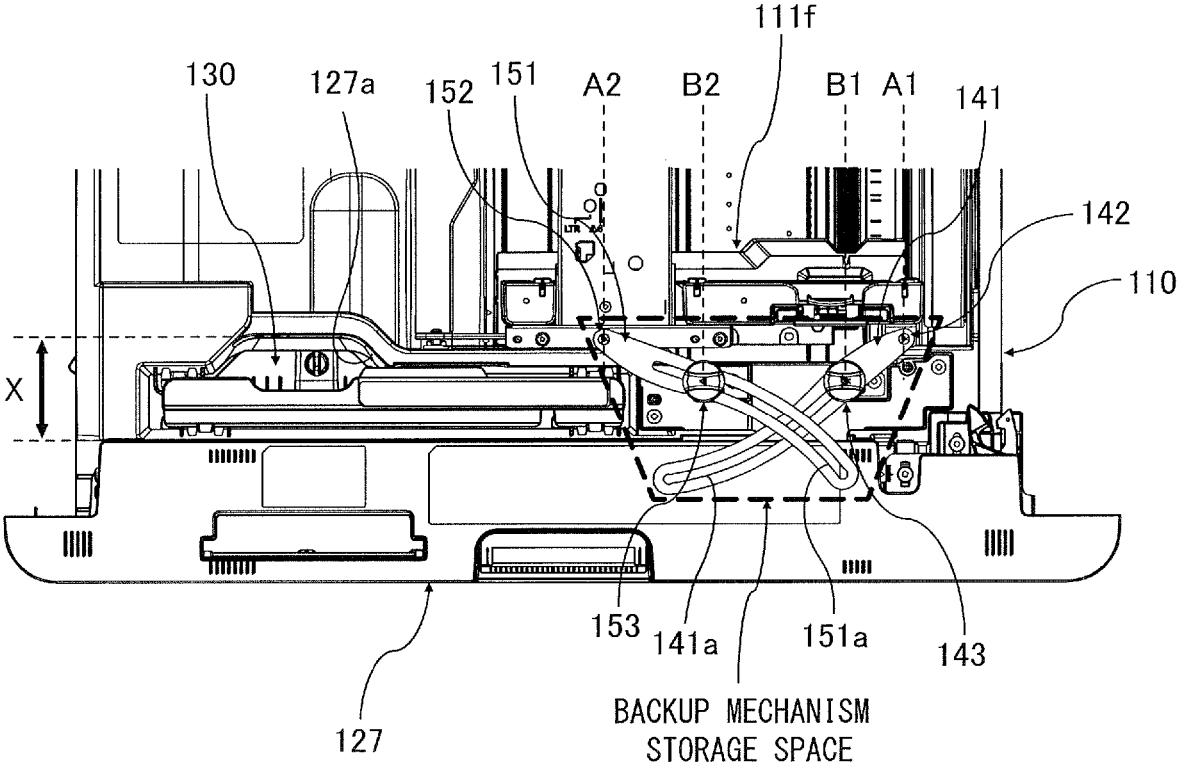
FIG. 8 is an upper plan view of the backup mechanism of the second embodiment.

Specifically, as illustrated in FIG. 8, positions B1 and B2, i.e., center positions of screw holes, of the first and second fixing screws 143 and 153 in the feeding direction D2 are positioned inside of positions A1 and A2 of the first and second support shafts 142 and 152 disposed apart in the feeding direction D2. Therefore, as the first arm plate 141 heads toward downstream in the cassette drawing-out direction D1 from the first support shaft 142, the first arm plate 141 takes a posture of being inclined with respect to the cassette drawing-out direction D1 so as to head toward upstream of the feeding direction D2. As the second arm plate 151 heads toward downstream in the cassette drawing-out direction D1 from the first support shaft 152, the second arm plate 151 also takes a posture of being inclined with respect to the cassette drawing-out direction D1 so as to head toward downstream of the feeding direction D2.

Magnitudes of the inclinations of the first and second arm plates 141 and 151 with respect to the cassette drawing-out direction D1 increase as the first and second support shafts 142 and 152 come closer to the first and second fixing screws 143 and 153. Accordingly, the first and second arm plates 141 and 151 intersect with each other when seen from the top at least in a state in which the side regulating plate 111*f* is moved to the outer position as illustrated in FIG. 8.

Positions in the height direction of the first and second support shafts 142 and 152 are different and are configured such that pivotal loci of the first and second arm plates 141 and 151 do not interfere with each other, i.e., such that the first arm plate 141 passes through a lower position in the present embodiment. In accordance with that, height of a seat surface 126A of the mount 126 in fixing the second arm plate 151 by the second fixing screw 153 is differentiated from height of a seat surface 126B of the mount 126 in fixing the second arm plate 151 by the second fixing screw 153 as illustrated in FIG. 7. In other words, the seat surfaces 126A and 126B have different heights in the gravity direction and constitute a step shape. In moving the side regulating plate 111*f* in a state in which the first and second fixing screws 143 and 153 are unscrewed, a lower surface of the first arm plate 141 slides on the seat surface 126A serving as a first surface and a lower surface of the second arm plate 151 slides on the seat surface 126B serving as a second surface. Accordingly, the first and second arm plates 141 and 151 are guided so as to smoothly intersect without interfering with each other.

In the state in which the side regulating plate 111*f* is moved to the outer position, the first and second arm plates 141 and 151 are stored in a space provided under a front cover 127 composing a downstream peripheral wall portion in the cassette drawing-out direction D1 of the sheet feeding tray 110 as illustrated in FIG. 7. At this time, as a result of disposing the first and second arm plates 141 and 151 so as to intersect with each other as described above, the two arm plates can be stored in a trapezoidal space in which a side downstream in the cassette drawing-out direction D1 is narrow when seen from a top view as illustrated in FIG. 8. Because the first and second arm plates 121 and 131 are inclined with the same angle in the case of the first embodiment illustrated in FIG. 9, a parallelogram space when seen from a top view is necessary under the front cover 127 in order to store the two arm plates. Therefore, it is possible to save the space necessary for storing the backup mechanism, i.e., the occupancy width in the feeding direction D2 in particular, to be small without narrowing a movable range of the side regulating plate 111*f* as compared to the first embodiment.

It is possible to dispose a handle for opening/closing the cassette and a mechanism for unlocking the sheet feeding cassette locked to the apparatus body by interlocking with a pivotal motion of a lever provided in the handle in the front cover 127 of the sheet feeding cassette. It is also possible to provide a storage space for storing an attachment, e.g., an option kit, that can be mounted within the cassette in the front cover 127. An exemplary attachment includes an auxiliary regulation member attached to the side regulating plates 111*f* and 111*r* and to the trailing end regulating plate 113 to regulate positions of a small size sheet such as a postcard. Another exemplary attachment includes an auxiliary support member including a swingable supporting plate and mounted on the sheet supporting portion 109 to support a lower surface of a sheet bundle to be able to stably feed sheets having uneven thickness such as an envelope.

In the present embodiment, a storage space 127*a* of an index sheet attachment 130 that enables to regulate an index sheet is provided as an example of an attachment accommodating portion at the front cover 127 as illustrated in FIG. 8. The index sheet attachment 130 regulates the position of the index sheet, i.e., a sheet having a tab projecting out of a part of a side end, by being attached to the regulation members such as the side regulating plates 111*f* and 111*r* and the trailing end regulating plate 113 or the sheet feeding tray 110 itself.

Then, the storage space 127*a* of the index sheet attachment 130 is provided upstream in the feeding direction D2 of the first and second arm plates 141 and 151 stored in the front cover 127. A range X in the cassette drawing-out direction D1 in which the storage space 127*a* is provided overlaps with the first and second arm plates 141 and 151 stored in the front cover 127. It is possible to readily assure the storage space 127*a* of the attachment in the sheet feeding tray 110 by thus arranging the backup mechanism in compact by disposing the two arm members of the backup mechanism so as to intersect with each other.

By the way, the first and second arm plates 141 and 151 have the curved shapes similarly to the first embodiment and are configured as members having the same shape. The first arm plate 141 is disposed in an orientation by which the occupancy width in the cassette drawing-out direction D1 in the state in FIG. 8 in which the side regulating plate 111*f* is moved to the outer position is reduced. In other words, the first arm plate 141 is disposed such that the closer to an edge portion on a side far from the first support shaft 142 in the state illustrated in FIG. 8, the smaller an angle between a tangential direction of the elongated hole 141*a* through which the first fixing screw 143 is inserted and the feeding direction D2 becomes.

In contrast, the second arm plate 151 is disposed in an orientation such that the closer to an edge portion on a side far from the first support shaft 152 in the state illustrated in FIG. 8, the greater an angle between a tangential direction of the elongated hole 151*a* through which the second fixing screw 153 is inserted and the feeding direction D2 becomes. This reason will be described below.

As illustrated in FIG. 8, a distance between A2 and B2 of the second support shaft 152 and the second fixing screw 153 in the feeding direction D2 is wider than a distance between A1 and B1 of the first support shaft 142 and the first fixing screw 143. Accordingly, in the state in which the side regulating plate 111*f* is moved to the outer position, the second arm plate 151 takes a posture of being closer to the feeding direction D2 more than the first arm plate 141. Therefore, even if the second arm plate 151 having the same curved shape with the first arm plate 141 is disposed in the orientation as illustrated in FIG. 8, it is possible to avoid increasing the occupancy width of the backup mechanism in the cassette drawing-out direction D1 by the second arm plate 151. Still further, if the second arm plate 151 is disposed by reversing its front and back so that its curved direction is reversed, there is a case where the second arm plate 151 is liable to interfere with the second fixing screw 153 and it becomes difficult to form the first and second arm plates 141 and 151 into the same shape.

Accordingly, it is possible to avoid the interference among the members and to obtain an effect of cutting the manufacturing costs by using the arm members formed into the same shape without increasing the occupancy width of the backup mechanism by disposing the two arm members having the same curved shape like the present embodiment.

Note that while the second arm plate 151 is disposed at the position higher than that of the first arm plate 141 in the present embodiment, the positional relationship of up and down may be reversed and the first arm plate 141 may be disposed at the higher position.

Third Embodiment

Next, a sheet feeding cassette of a third embodiment will be described with reference to FIG. 10. The present embodiment is different from the second embodiment in that the two arm members constituting a backup mechanism of regulation members are fixed by one screw member. Component elements having the same configuration and action with those of the first or second embodiment will be denoted by the common reference signs, and their description will be omitted here.

Figure 10:
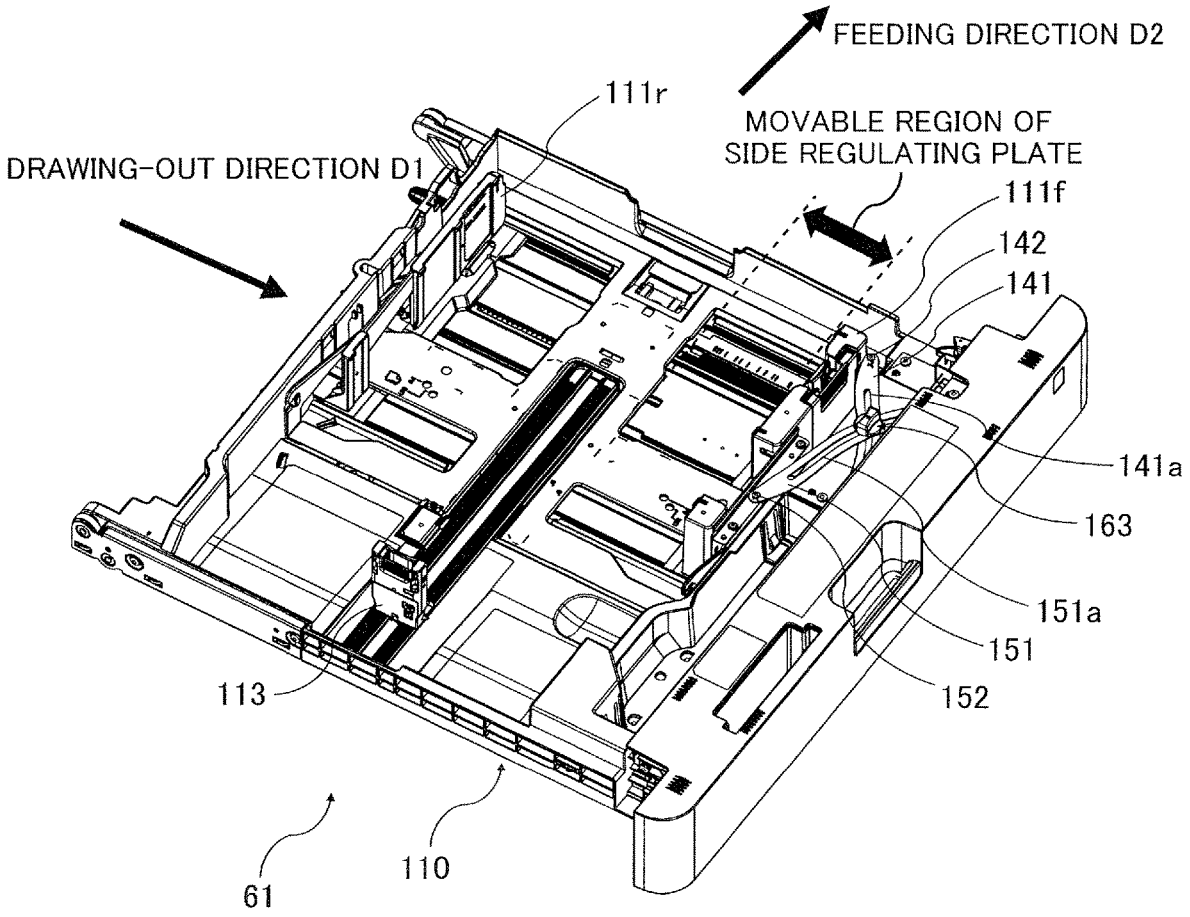
FIG. 10 is a perspective view of a sheet feeding cassette of a third embodiment.

As illustrated in FIG. 10, one fixing screw 163 is screwed to a female screw portion provided through the sheet feeding tray 110 in a state in which the fixing screw 163 penetrates through elongated holes 141*a* and 151*a* of the first and second arm plates 141 and 151 in the backup mechanism of the present embodiment. Accordingly, if the user unscrews the fixing screw 163, both of the first and second arm plates 141 and 151 are allowed to move with respect to the sheet feeding tray 110 and the user can move the side regulating plates 111*f* and 111*r* in the sheet width direction. Both of the first and second arm plates 141 and 151 are fixed to the sheet feeding tray 110 by screwing the fixing screw 163 being unscrewed. Thus, it is possible to enhance usability by reducing works of the user by arranging such that the respective arm plates can be fixed by the fixing screw 163 at a spot where the first and second arm plates 141 and 151 intersect with each other.

Note that the present embodiment is arranged such that the first and second arm plates 141 and 151 always intersect with each other at the position of the fixing screw 163 even if the side regulating plate 111*f* is located at any place in the entire movable region in the sheet width direction. In contrast to that, the first arm plate 141 does not intersect with the second arm plate 151 when seen from a top view when the side regulating plate 111*f* is located at a position of a part of the movable region, i.e., when the side regulating plate 111*f* is located at the inner position in particular, in the second embodiment described above. However, it is possible to obtain an advantage that enables to downsize the whole apparatus by enabling to store the two arm members within the small space by either one of the second embodiment and the present embodiment.

Other Examples

While the backup mechanism is disposed only on the front side of the printer, i.e., downstream in the cassette drawing-out direction D1, in the first through third embodiments described above, no backup mechanism is provided for the side regulating plate 111*r* on the rear side of the printer. However, the same backup mechanism with those described in the first through third embodiments may be provided for the side regulating plate 111*r* on the rear side of the printer.

Still further, the backup mechanism of the side regulating plate 111*f* regulating the end position of the sheet in the sheet width direction has been described as an example of the regulation member in the first through third embodiments, the configuration of each embodiment may be used as a backup mechanism of the trailing end regulating plate 113. For instance, in a case of a configuration in which a direction of inserting and drawing out the sheet feeding cassette, i.e., the first direction, is aligned with the feeding direction D2 in which the sheet is fed from the sheet feeding cassette, it is possible to effectively regulate deformation and positional deviation of the trailing end regulating plate 113 by a backup mechanism similar to those of the respective embodiments.

Still further, the configurations described in each of the embodiments described above are applicable to the other sheet feeding cassette 62 through 64 of the printer 100 (see FIG. 1). The technology of the present disclosure is applicable not only the sheet storage apparatus incorporated in the apparatus body of the image forming apparatus as described above in the embodiments but also to a sheet storage apparatus, i.e., an option feeder, configured to deliver a sheet stored in the sheet storage apparatus connected to the image forming apparatus to the image forming apparatus.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-086861, filed on Apr. 26, 2019, which is hereby incorporated by reference herein in its entirety.

What is claimed is:

1. An image forming apparatus comprising:

an image forming unit configured to form an image on a sheet;

a sheet feeding cassette configured to store the sheet and drawable in a drawing-out direction;

a feeding unit configured to feed the sheet stored in the sheet feeding cassette toward the image forming unit in a feeding direction orthogonal to the drawing-out direction;

a side regulating plate provided in the sheet feeding cassette configured to be movable in the drawing-out direction with respect to the sheet feeding cassette, and comprising a regulating surface configured to regulate an end position in the drawing-out direction of the sheet stored in the sheet feeding cassette;

a first arm connected with a first connector of the side regulating plate and configured to pivot on an axis extending in a gravity direction;

a second arm connected with a second connector of the side regulating plate and configured to pivot on an axis extending in the gravity direction, wherein the second connector is different from the first connector in terms of the feeding direction;

a first fixing part configured to fix the first arm to the sheet feeding cassette; and a second fixing part configured to fix the second arm to the sheet feeding cassette, wherein the first arm is configured to intersect with the second arm when viewed in the gravity direction in a state in which the side regulating plate is located in at least a part of a movable range of the side regulating plate.

2. The image forming apparatus according to claim 1, wherein the sheet feeding cassette comprises a first surface to be in contact with a lower surface of the first arm in the gravity direction and a second surface to be in contact with a lower surface of the second arm in the gravity direction, and wherein a height of the first surface in the gravity direction is different from a height of the second surface.

3. The image forming apparatus according to claim 1, wherein the first and second arms are configured to pivot with respect to the side regulating plate while being guided respectively by the first and second fixing parts in a case where the side regulating plate moves in the drawing-out direction, and wherein both of the first and second fixing parts are positioned between the first and second connecting positions in terms of the feeding direction.

4. The image forming apparatus according to claim 1, wherein the first connector connecting portion is positioned on a first side and the second connector is positioned on a second side with respect to a center position, in terms of the feeding direction, between both end portions in the feeding direction of a range in which the regulating surface is contactable with an end portion of the sheet.

5. The image forming apparatus according to claim 1, wherein the first and second connectors are positioned at positions in terms of the gravity direction higher than a half of a height of an upper end of the regulating surface with respect to a lower end of the regulating surface.

6. The image forming apparatus according to claim 1, wherein the first fixing part is a first screw member attached to the sheet feeding cassette in a state of penetrating through an elongated hole formed through the first arm, and wherein the second fixing part is a second screw member attached to the sheet feeding cassette in a state of penetrating through an elongated hole formed through the second arm.

7. The image forming apparatus according to claim 6, wherein each of the first and second screw members comprises a shaft portion penetrating through the elongated hole and a head provided at an upper end of the shaft portion, the head comprising a knob shape to be rotationally operated.

8. The image forming apparatus according to claim 6, wherein at least one of the first and second arms is curved and is disposed in an orientation by which an occupancy width in the drawing-out direction is reduced in a state where the side regulating plate has been moved to an outermost position in terms of the drawing-out direction.

9. The image forming apparatus according to claim 1, further comprising:

a trailing end regulating plate configured to be movable in the feeding direction with respect to the sheet feeding cassette and configured to regulate a trailing end, in the feeding direction, of the sheet stored in the sheet feeding cassette.

10. The image forming apparatus according to claim 1, wherein the sheet feeding cassette is provided with an attachment accommodating portion configured to accommodate an attachment attachable to the sheet feeding cassette at a position different from positions of the first and second fixing parts in terms of the feeding direction, and wherein positions in the drawing-out direction of the first and second fixing parts each overlap with a position in the drawing-out direction of the attachment accommodating portion.

11. The image forming apparatus according to claim 1, further comprising a second side regulating plate disposed to face the side regulating plate, which is a first side regulating plate, in the drawing-out direction, wherein the first side regulating plate is located downstream of the second side regulating plate in the drawing-out direction, and wherein the first and second fixing parts are disposed at a peripheral wall portion on a downstream side of the sheet feeding cassette in the drawing-out direction.

* * * * *